United States Patent [19]

Vieten

[11] Patent Number: 4,774,971

[45] Date of Patent: Oct. 4, 1988

[54] CIGARETTE SUBSTITUTE

[76] Inventor: Michael J. Vieten, 77 Eighth Ave., Brooklyn, N.Y. 11215

[21] Appl. No.: 870,124

[22] Filed: Jun. 3, 1986

[51] Int. Cl.[4] ..... A24F 1/00

[52] U.S. Cl. ..... 131/273; 131/270; 131/362

[58] Field of Search ..... 131/360, 270, 273, 359, 131/362

[56] References Cited

U.S. PATENT DOCUMENTS

| | | | |
|---|---|---|---|
| 3,789,840 | 2/1974 | Rosenblatt | 131/273 |
| 4,284,089 | 8/1981 | Ray | 131/270 |
| 4,579,858 | 4/1986 | Ferno et al. | 131/270 |

*Primary Examiner*—V. Millin

*Attorney, Agent, or Firm*—John H. Faro

[57] ABSTRACT

A cigarette substitute is provided which satisfies the smokers psychological and pharmacological need for a cigarette, without exposing him, or others, to the ill-effects associated with inhalation of smoke, tar and other combustion products. This cigarette substitute is a smokeless cigarette designed to satisfy the smokers physical and pharmacological needs of nicotine, without subjecting either the smoker, or others in his immediate vicinity, to exposure to cigarette smoke. It is also intended to satisfy the smoker's psychological needs of having something to occupy the hands and/or mouth and to simulate the act of puffing on a cigarette.

7 Claims, 1 Drawing Sheet

CIGARETTE SUBSTITUTE

BACKGROUND OF THE INVENTION

1. Field of the Invention

This invention is directed to an article of manufacture. More specifically, this invention concerns itself with a cigarette substitute which is designed to satisfy the psychogenic drives and pharmacological needs of the smoker, without subjecting the smoker, or others in his immediate vicinity, to exposure to cigarette smoke, or other unwanted intrusions upon his person.

2. Description of the Prior Art

The potential ill-effects inherent in smoking cigarettes and other tobacco products are well documented and need not be repeated here. Because of the recognized risks associated with smoking, the tobacco industry has introduced products having low tar and nicotine content; enhanced the efficiency of the filters on their filtered cigarettes; and labeled the cigarette pack, as directed by the Surgeon General of the United States Public Health Service, to provide an informatinal message warning the purchaser of the health risks associated with smoking. All of the measures taken by the tobacco industry, the warnings of the Surgeon General, the educational programs and messages from national associations concerned with heart disease and lung cancer, and incentives for medical/health insurance have done little to dissuade the habitual smoker from continuing to smoke. The reasons underlying his resistance to break this habit are three-fold:

(a) The psychological and social drives associated with smoking, namely, the apparent need or ritual involved in the lighting and holding of a cigarette and gratification derived by placing it in one's mouth;

(b) to simulate the act of puffing on a cigarette; and (c) the pharmacological effects of nicotine upon the body.

Because of the above health risks and the inability, or reluctance, of the tobacco industry to produce a less toxic product, various alternatives to the conventional cigarette have been proposed. These alternatives generally fall into two categories:

(a) cigarettes incorporating some feature designed to lessen the effects of inhalation of smoke, or modulate the amount/quality of smoke that is inhaled; and (b) devices which simulate cigarettes without the production of combustion products.

U.S. Pat. Nos. 3,439,685; 4,319,587 and 4,492,239; Canadian Patent No. 787,688; U.K. Patent Nos. 1,014,452 and 1,113,943; and German Patent No. 1,053,996 are fairly representative of the cigarettes referred to in category (a) above. More specifically, all of the devices described in the foregoing patents involve either attempts at modification of the combustion process or the products of combustion.

More specifically, U.S. Pat. No. 4,492,239 proposes the modification of a tobacco filler, or tobacco substitute, with a chemical agent (i.e. a lacrimator). This chamical substance is released during the combustion of the tobacco filler, thereby producing a gas which is offensive to the smoker (and presumably all non-smokers in this immediate vicinity).

U.S. Pat. No. 3,439,685 suggests the use of a series of cigarettes, each series having a different nicotine content and a varying concentration of unpleasant tasting substance. This patent suggests weaning the smoker off of cigarettes by progressively decreasing the nicotine content in each of the series of cigarettes and while at the same time progressively increasing the content of the unpleasant tasting substance in each series of cigarettes. The underlying hypothesis of the invention is that such progressive change in the cigarette from the high to low nicotine content and from the low to high content of unpleasant tasting substance, will result in breaking the smokers psychological need for cigarettes because of the unpleasantness associated with smoking. Moreover, the physical need for nicotine is also eliminated by such progressive reduction in its uptake.

U.S. Pat. No. 4,319,587 describes a method for enabling a smoker to modulate his consumption of cigarettes. The expedient suggested for achieving this result is the provision of some type of reference marks (graduations), or indices, imprinted along the length of the cigarette wrapper. These indices allow the smoker to gauge the extent to which the cigarette is smoked. Its success is, thus, based entirely upon the willingness of the smoker to limit the amount of his smoking based upon some standard which he himself is to set.

Canadian Patent No. 787,688 illustrates a smoking device which is designed to reduce the ratio of particulate matter (i.e. tar) to nicotine in cigarette smoke while at the same time satisfying the smokers physical needs for nicotine. In this device, a hollow channel is provided within a modified cigarette. The interior of this channel is coated with a substance that liberates a nicotine aerosol at elevated temperatures. Thus, as this device is smoked, the amount of smoke which is inhaled by the smoker will be diluted by the air from the central channel. Notwithstanding a reduction in the quantity of smoke inhaled, the nicotine consumption will remain essentially unchanged, since any deficiency in the nicotine from the amount of smoke which is inhaled is more than offset by the nicotine aerosol.

U.K. Patent No. 1,014,452 is similar in its disclosure to U.S. Pat. No. 4,319,587 (previously discussed). This patent simply suggests the placement of some indices on the cigarette wrapper to alert the smoker not to smoke the cigarette beyond this indexing mark. Accordingly, this device is entirely dependent on self policing by the smoker and does not otherwise alter the quantity or quality of the smoke that is inhaled.

U.K. Patent No. 1,113,943 is somewhat similar to U.S. Pat. No. 4,492,239 (previously discussed). As the cigarette is smoked, it will be consumed to a point where it releases an unpleasant smell or taste, or some other indicia to alert the smoker to discontinue smoking. Under some conditions, the modification of the cigarette can prevent the smoker from further drawing smoke through the mouthpiece end.

German Patent No. 1,053,996 describes a device having an annular restriction around the cigarette near the mouthpiece end. This restriction presumably makes it more difficult for the smoker to draw smoke through the cigarette and, thus, presumably reduces the amount of smoke inhaled.

U.S. Pat. No. 4,284,089 is representative of the cigarettes referred to in category (b) above. More specifically, the device described in this patent does not resort to combustion in its attempt at satisfying the smokers craving for nicotine. In the device described in this patent, a source of vaporizable nicotine is absorbed onto a transfer medium. This transfer medium is packed within a cigarette-like structure. An air channel is provided within the structure from one end to the other and is surrounded by the absorbent material. The nature of the air channel is such as to create a venturi effect from one end of this device to the other. Upon drawing air through the air channel, the vaporizable nicotine is drawn through pores in the channel and inhaled by the smoker. The venturi-like structure of the channel creates a pressure drop furthering the vaporization of the nicotine. The patentee acknowledges one serious drawback in his device, in that the vaporizable nicotine which is drawn into the air channel depletes the source of this material in the immediate vicinity of the channel. Once the area in immediate contact with the air channel is depleted of vaporizable material, no further nicotine can be drawn into the air channel for a finite period until the source of vaporizable nicotine diffuses within the absorbent material to the vicinity of the air channel and thereby replaces that which has been previously depleted. Accordingly, this device, at best, provides an intermittent source of nicotine for the smoker and, thus, as presently configured, cannot adequately simulate cigarette smoking.

As is evident from the foregoing discussion, the vast majority of devices which have been conceived for reducing smoker dependency upon cigarettes involve some form of combustion or combustion products. In each of such instances, not only is the smoker exposed to such combustion products, but also the nonsmoker in the immediate vicinity. The nonsmoker, or the passive smoker, is becoming increasingly intolerant of these intrusions upon his person, and where such combustion products contain additional offensive agents, such tolerance will indeed by short-lived.

In those devices where combustion products are not produced, it is apparent that the simulation of smoking is not adequately achieved nor can the smokers physiological needs for nicotine be adequately satisfied.

Thus, there is a continuing need for an adequate substitute for cigarette smoking which can satisfy the smokers cravings for nicotine, fulfills his needs to physically simulate the act of smoking and yet avoids subjecting the nonsmoker to combustion products to which he may be allergic or to which he finds offensive.

OBJECTS OF THE INVENTION

It is the object of this invention to remedy the above as well as related deficiencies in the prior art.

More specifically, it is the principal object of this invention to provide a smokeless cigarette substitute which does not involve the generation or consumption of combustion products and yet satisfies the individual's need to simulate the act of smoking.

It is another object of this invention to provide a smokeless cigarette substitute which satisfies both the psychological and pharmacological needs associated with the smoking of tobacco products without the generation or inhalation of the combustion products of tobacco.

It is yet another object of this invention to provide a smokeless cigarette substitute having a consumable confection associated with one end thereof which contains nicotine, nicotine derivatives and/or nicotine substitutes.

It is still yet another object of this invention to provide a smokeless cigarette substitute in which a consumable confection containing nicotine is stored within the substitute cigarette and extended from, or withdrawn into, the structure of the cigarette substitute, depending upon whether or not the cigarette substitute is in use.

SUMMARY OF THE INVENTION

The above and related objects are achieved by providing a cigarette substitute having a tubular element corresponding in size, shape and appearance to that of a conventional cigarette. This tubular element is provided with a filter tip-like element at the mouthpiece end and is otherwise optionally composed of an essentially draw resistant material within the tubular element. The phrase "draw resistant" is intended as encompassing those materials which permit the passage of air or aerosol in the same manner as would the filler or filter element of an authentic cigarette. The filter tip-like element is of a cylindrical shape and somewhat smaller in diameter than the tubular element itself. A consumable confection encompasses the filter tip-like element and may be ingested by the user by simply placing this end of the cigarette substitute between his lips as if he were engaging in the act of smoking. This confection can be a self-supporting cylinder or applied directly to the filter tip-like element. In the embodiment of this invention in which the confection is a self-supporting element, it can be provided with the cigarette substitute, or supplied separately and simply installed upon the substitute by the user.

In one of the preferred embodiments of this invention, this confection, in cylinder form, is stored within the forward portion of the cigarette substitute and simply telescopingly fed from its place of storage, in a direction of the filter element. Upon arriving at the appropriate degree of extension, the user can consume a portion of this confection as he would a Lifesaver TM or other readily dissolvable candy, and then advance a new section to take its place.

The consumption of this confection can vary with the individual preferances of the user. In all cases, however, the confection will contain sufficient nicotine, nicotine derivatives and/or the pharmacological equivalent of nicotine and/or its derivatives to satisfy the nicotine cravings of the user. Other ingredients contained within the confection can also mimic other components of cigarette smoke and/or impart flavors and fragrances during its consumption.

DESCRIPTION OF THE INVENTION INCLUDING PREFERRED EMBODIMENTS

Figure 1:
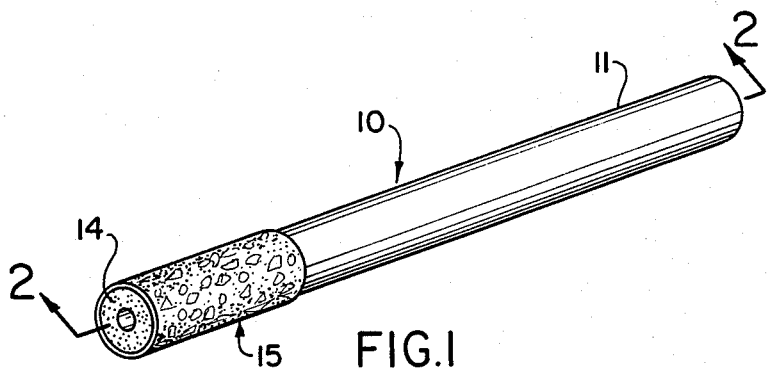
FIG. 1 is a perspective view of a cigarette substitute of this invention.

The cigarette substitute (10) of this invention includes an elongate tubular member (11) defining a passageway therethrough, a draw resistant inert material (12) contained within at least a portion of this passageway, a filter tip-like element (14) connected to and in cooperative relation with the elongate tubular member, and a consumable confection (15) associated with the filter tip end of this device containing nicotine, nicotine derivatives and/or nicotine substitutes. The overall appearance, size and feel of the cigarette substitute of this invention faithfully conforms to a real cigarette, except for the fact that it is not intended for, nor will it support combustion in the manner of a real cigarette.

The elongate cylindrical (11) portion of this device is typically composed of paper or even a plastic material. The interior of this tubular member will generally contain some inert filler (12) to lend support to its structure and provide draw resistance in the manner analogous to that encountered by the smoker when smoking a real cigarette.

In one of the preferred embodiments of this invention, this elongate tubular portion of the cigarette substitute can accommodate storage of the confection (15) containing the nicotine, nicotine derivatives and/or nicotine substitute.

The filtered tip (14) end of the cigarette will conform in size and shape to the filter of a conventional cigarette. It is attached to the elongate tubular member in a manner similar to that of a real cigarette, or can simply be an extension of the support member which is housed within the tubular component of the cigarette itself. The diameter of the filter tip end of the cigarette is somewhat smaller than the elongate tubular member and thereby permits placement of the confection (15) thereon.

The confection portion (15) of the cigarette can be applied to the filter tip end of the cigarette or comprise a self-supporting member adapted to conform to the filter tip end of the cigarette and be supported thereby. In one of the preferred embodiments of this invention, the confection is a self-supporting element and can be sold separate and apart from the cigarette itself. Its overall length can exceed that of the filter portion of the cigarette and that portion in excess of the length of the filter be stored within the interior of the forward portion of the cigarette substitute.

The confection component of the cigarette would generally comprise an ingestible binder, artificial coloring, artificial flavoring and nicotine (d), nicotine (l), nicotine (dl), nicotine salts, nicotine esters, and/or any combination thereof. These materials are readily commercially available and can be formulated with a confection in the appropriate proportion to produce a consumable product which will satisfy the cravings of the cigarette user without exposing him or others to tobacco combustion products. The confection can be flavored with spearmint, wintergreen, peppermint or any other flavor which is desirable or pleasant. These types of flavoring agents can produce a totally unexpected result, namely, freshen the "smokers" breath during the consumption of the confection. The forward tubular member of the cigarette can also contribute to the simulation of smoking by incorporating one or more vaporizable ingredients (13) onto a porous absorptive member, (e.g. U.S. Pat. No. 4,284,089). The cigarette substitute of this invention would not, however, tolerate the use of any vaporizable agent which could be a potential source of irritation to the user's respiratory system or contain any of the potentially harmful combustion products encountered in cigarette smoke. In one of the preferred embodiments of this invention, such vaporizable materials could be contained in microcapsules either within the filter element at the mouthpiece end or in the forward tubular member of the cigarette substitute. These capsules could be fractured during use by simply compressing a resilient portion of the filter of forward tubular member, or, alternatively, providing an additional expedient to impart an abrasive action between these microcapsules and one or more components of the cigarette substitute.

The ingestible binder component of this composition is preferably a sugar base material or sugar substitute based material which is capable of dissolving or serving as a binder for the nicotine and nicotine like components of the confection, forming a solid at room temperature. As noted above, the resultant composition containing these ingredients must be capable of either forming a coating on the filter portion of the cigarette substitute or being cast into a self-supporting structure which can be adapted to fit on the filter tip-like end of the cigarette substitute. This binder can be typically composed of the same confection as spearmint flavored Lifesavers TM or white chocolate.

The absence of tobacco combustion products is a significant advantage in this type of device, since it is known that the tar component of cigarette smoke is particularly harmful and is a known carcinogen. The ingestion of nicotine through the digestive system does not present similar hazards to the user, and yet can satisfy, in essentially the same way as smoking, the nicotine needs and cravings of the cigarette smoker.

FIG. 1 is representative of one embodiment of the cigarette substitute of this invention. As illustrated in FIG. 1, this device comprises an essentially elongate tubular forward member which is essentially the same in size and appearance as a real cigarette.

Figure 2:
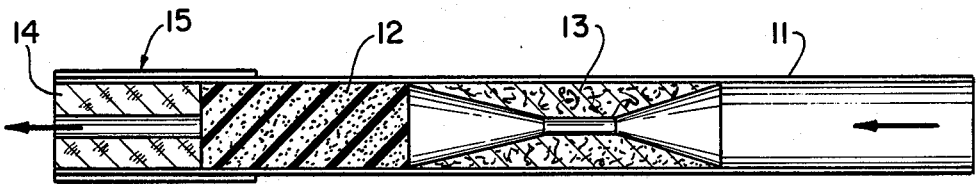
FIG. 2 is an enlarged view, in partial section, of the filter tip/confection end of the cigarette substitute of FIG. 1.

FIG. 2 illustrates an enlarged view of the device illustrated in FIG. 1. The filter tip end of the cigarette is, however, enlarged and partially exposed to illustrate the relationship of the nicotine contained confection relative to the filter tip and the forward portion of the cigarette as well.

Figure 3:
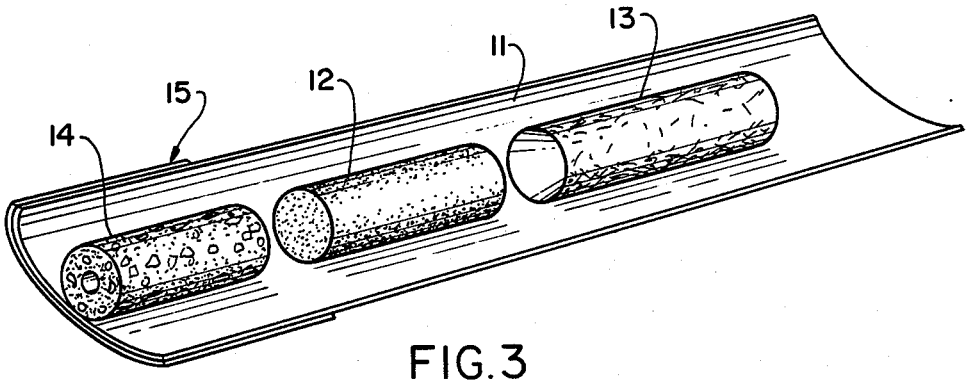
FIG. 3 is an exploded view of the cigarette substitute of FIG. 1.

FIG. 3 illustrates an exploded view of the cigarette substitute of FIG. 1. In an alternative embodiment of this invention (not shown), the elongate tubular component provides a forward storage compartment for the confection and means are also included for advancing and withdrawing the confection from this forward compartment relative to the filter tip end of the cigarette. As is evident from this alternate design, the cigarette substitute may in fact be reusable and the user simply purchase replacement confections as they are consumed. The structure and function of the cigarette substitute in this case, would be analogous to that of a cigarette holder in which the smoker simply replaces the consumable component of the assembly.

Figure 4:
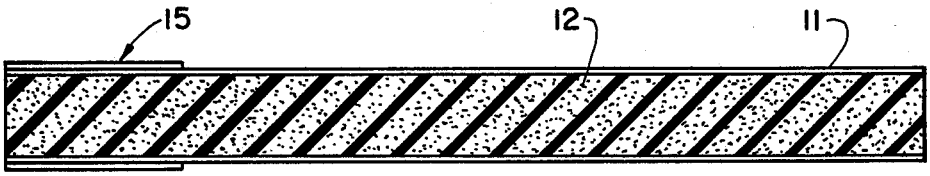
FIG. 4 is a perspective view of a simplified version of the cigarette substitute of this invention.

FIG. 4 illustrates a simplified embodiment of the device of this invention. In this embodiment, the draw resistant filter-like material extends the entire length of the cigarette substitute. That portion of material in the forward portion of the cigarette occupies essentially all of the space within the tubular elements and that portion which extends for the mouthpiece being coated with a nicotine containing confection. The portion of the draw resistant material forming the mouthpiece is initially coated with an impermeable material to provide a supporting surface for the confection. The failure to provide such an impermeable interface between the confection and draw resistant material can result in some of this material being ingested along with the confection.

The foregoing description and drawings illustrate a number of the preferred embodiments of this invention. As is apparent to one skilled in the art, various changes may be made in the configuration, sizes and arrangements of the parts illustrated herein without departing from the spirit or scope of the inventor's concept. Therefore, the specific illustrations hereinabove are intended only as illustrative of an inventor's concept, and not intended as delineating its scope, which is set forth in the claims which follow.

What is claimed is:

1. A cigarette substitute having the size, shape and overall appearance of a real cigarette and yet devoid of tobacco filler, comprising:

(a) an essentially elongate tubular element having one end thereof adapted to accept a filter tip-like element;

(b) a filter tip-like element, adapted to cooperatively engage one end of the tubular member, and thereby a draw resistant passage of air from the open end of the tubular member, said filter tip-like element having a cross-sectional area somewhat less than the cross-sectional area of the tubular member; and (c) a consumable confection disposed upon and conforming to the outer cylindrical surface of the filter tip-like element, said confection being capable of ingestion by the user of said cigarette substitute by simply placement thereof between his lips during emulation of the act of smoking, the composition of said confection comprising (i) sufficient nicotine, nicotine derivatives and/or nicotine substitutes to satisfy the pharmacological needs for nicotine of the user; and (ii) an ingestible binder which is capable of either melting upon contact with the user's lips and/or dissolving upon contact with saliva from the user's mouth.

2. The cigarette substitute of claim 1, wherein the tubular member is adapted to house a consumable confection and advance a portion thereof toward the filter end of the cigarette substitute as said confection is consumed by the user.

3. The cigarette substitute of claim 1, wherein the consumable confection comprises, in addition to nicotine, one or more additional ingredients which mimic the flavors and/or fragrances commonly encountered by smoking of a real cigarette.

4. The cigarette substitute of claim 1, wherein the filter tip-like element is coated with the consumable confection.

5. The cigarette substitute of claim 1, wherein the consumable confection contains a breath freshner, or other desired flavor/taste.

6. The cigarette substitute of claim 1, wherein the filter tip-like element contains a breath freshner, or other desired flavor/taste.

7. The cigarette substitute of claim 1, wherein the elongate tubular element contains a breath freshner.

* * * * *